US008950152B2

(12) United States Patent
Milkiewicz

(10) Patent No.: US 8,950,152 B2
(45) Date of Patent: Feb. 10, 2015

(54) ADJUSTABLE ANCHOR SYSTEM

(71) Applicant: David P. Milkiewicz, East Greenbush, NY (US)

(72) Inventor: David P. Milkiewicz, East Greenbush, NY (US)

( * ) Notice: Subject to any disclaimer, the term of this patent is extended or adjusted under 35 U.S.C. 154(b) by 0 days.

(21) Appl. No.: 13/778,519

(22) Filed: Feb. 27, 2013

(65) Prior Publication Data

US 2013/0219823 A1 Aug. 29, 2013

Related U.S. Application Data

(60) Provisional application No. 61/603,657, filed on Feb. 27, 2012.

(51) Int. Cl.
*E04B 1/41* (2006.01)

(52) U.S. Cl.
CPC ..... *E04B 1/4114* (2013.01)
USPC ..... 52/710; 52/742.15

(58) Field of Classification Search
CPC ... E04B 1/4107; E04B 1/4164; E04B 1/4157; E04B 1/4114; E04B 1/4135; E04B 1/4142; E04B 1/4123; E04B 1/4128; E04B 2001/268; E04B 2001/2684; F16B 37/045; E04H 12/2269
USPC ..... 52/710, 711, 742.15, 293.3, 298
See application file for complete search history.

(56) References Cited

U.S. PATENT DOCUMENTS

| | | | | | |
|---|---|---|---|---|---|
| 1,386,509 | A * | 8/1921 | Kirmes et al. | 52/710 |
| 1,718,402 | A * | 6/1929 | Bitney | 52/710 |
| 1,848,949 | A * | 3/1932 | Halden | 52/710 |
| 2,181,740 | A * | 11/1939 | Reiland | 52/710 |
| 2,312,338 | A * | 3/1943 | Hulme | 52/710 |
| 2,785,842 | A * | 3/1957 | Phelps | 182/92 |
| 2,952,947 | A * | 9/1960 | White | 52/708 |
| 2,954,647 | A * | 10/1960 | Lee | 52/707 |
| 3,449,883 | A * | 6/1969 | Juten et al. | 52/710 |
| 3,715,851 | A * | 2/1973 | Bennett | 52/707 |
| 3,852,931 | A * | 12/1974 | Morse et al. | 52/293.3 |
| 3,943,670 | A * | 3/1976 | Miller | 52/23 |
| 4,719,724 | A * | 1/1988 | Ditcher | 52/20 |
| 4,871,279 | A * | 10/1989 | Hinterholzer | 404/10 |
| 6,151,856 | A * | 11/2000 | Shimonohara | 52/426 |
| 7,654,057 | B2 * | 2/2010 | Zambelli et al. | 52/710 |
| 2004/0010993 | A1 * | 1/2004 | Meadowcroft | 52/297 |
| 2007/0039281 | A1 * | 2/2007 | Zambelli et al. | 52/710 |

* cited by examiner

*Primary Examiner* — Christine T Cajilig
(74) *Attorney, Agent, or Firm* — Heslin Rothenberg Farley & Mesiti P.C.; Victor A. Cardona, Esq.

(57) ABSTRACT

A sleeve for creating a moveable anchor in concrete may include an open end and a closed end. A cavity may be formed within a rigid wall, and the cavity and the rigid wall may extend from the open end to the closed end. The sleeve may also include a hollow foot section formed at the closed end and in communication with the cavity. An adjustable anchor system may include a sleeve and a moveable bolt. The sleeve may include cavity extending from an open end to a closed end. The sleeve may also include a hollow foot section formed at the closed end and in communication with the cavity. The bolt may include a shaft disposed within the cavity and extending through the open end, and an angled portion disposed within the foot section.

21 Claims, 12 Drawing Sheets

ADJUSTABLE ANCHOR SYSTEM

CROSS-REFERENCE TO RELATED APPLICATIONS

This application claims priority to U.S. Provisional Application No. 61/603,657 filed on Feb. 27, 2012, the entire disclosure of which is incorporated herein by reference.

TECHNICAL FIELD OF THE INVENTION

This invention relates generally to wall anchors, and more particularly to anchors for securing objects to concrete.

BACKGROUND OF THE INVENTION

Anchor bolts for securing framing to a concrete foundation are often placed into concrete when the concrete is poured, but the exact location of the bolts is often unknown. The placement of the bolts is often a guess of where anchors are eventually needed. The anchors, however, are preferably located within a middle third of wood framing placed on top of the concrete. The pre-placed anchors (i.e., anchors placed during an initial concrete pour) are often located in the wrong spot and/or are off center and do not appropriately support the wall and corresponding structure. The pre-placed anchors then have to be replaced with an appropriately positioned anchor. New anchors may be created by drilling a hole in the poured and now cured concrete and placing a bolt within the hole. However, the new bolt may not reach a sufficient depth for building codes, and may not provide as strong a connection to the foundation as anchors inserted during an initial concrete pour.

Thus, a need exists for an anchor that may be positioned within concrete after the concrete has been poured and which extends to a sufficient depth.

SUMMARY OF THE INVENTION

The invention provides, in one aspect, a sleeve for use in a moveable anchor in concrete. The sleeve may include an open end and a closed end. A cavity may be bounded by a rigid wall, the cavity and the rigid wall extending from the open end to the closed end. The sleeve may also include a hollow foot section formed at the closed end and in communication with the cavity. The hollow foot section may be disposed at a ninety-degree angle relative to the rigid wall and the cavity. The hollow foot section may also include a first lateral end and a second lateral end. The hollow foot section may extend farther away from the cavity at the second lateral end than the first lateral end.

The invention provides, in another aspect, an adjustable anchor system including a sleeve and a moveable bolt. The sleeve may be configured to be received in concrete and include an open end and a closed end. The sleeve may also include a cavity formed within a rigid wall extending from the open end to the closed end. The sleeve may also include a hollow foot section formed at the closed end and in communication with the cavity. The moveable bolt may include a shaft disposed within the cavity and extending through the open end and an angled portion disposed within the hollow foot section. The angled portion of the moveable bolt may be angled at a ninety-degree angle relative to the shaft of the moveable bolt. The adjustable anchor system may also include a cover removably attached to the open end of the sleeve. The adjustable anchor system also includes a flange extending away from the open end and is configured to hold the sleeve at an appropriate height as the concrete sets.

The invention provides, in another aspect, a method for movably anchoring a structure within a concrete foundation. The method may include positioning a sleeve at a target site. The method may include pouring the concrete about the target site, then installing the sleeve and allowing the concrete to harden. The method may also include disposing a moveable bolt within the sleeve. The method may include rotating the movable bolt to dispose the angled portion within the hollow foot section. The method may also include securing a frame to the concrete or the foundation by connecting the frame to the moveable bolt.

The method may also include moving the movable bolt through the cavity to a desired position. The method may also include removing a cover removably attached to the sleeve at the open end of the cavity. The method may also include filling the cavity with at least one of dirt, concrete, caulk, spray foam, or other suitable material.

Other additional features and benefits will become apparent from the following drawings and descriptions of the invention. Other embodiments and aspects of the invention are described in detail herein and are considered a part of the claimed invention.

BRIEF DESCRIPTION OF THE DRAWINGS

The subject matter which is regarded as the invention is particularly pointed out and distinctly claimed in the claims at the end of the specification. The foregoing and other features and advantages of the invention are apparent from the following detailed description taken in conjunction with the accompanying drawings in which:

DETAILED DESCRIPTION OF THE DRAWINGS

Figure 1:
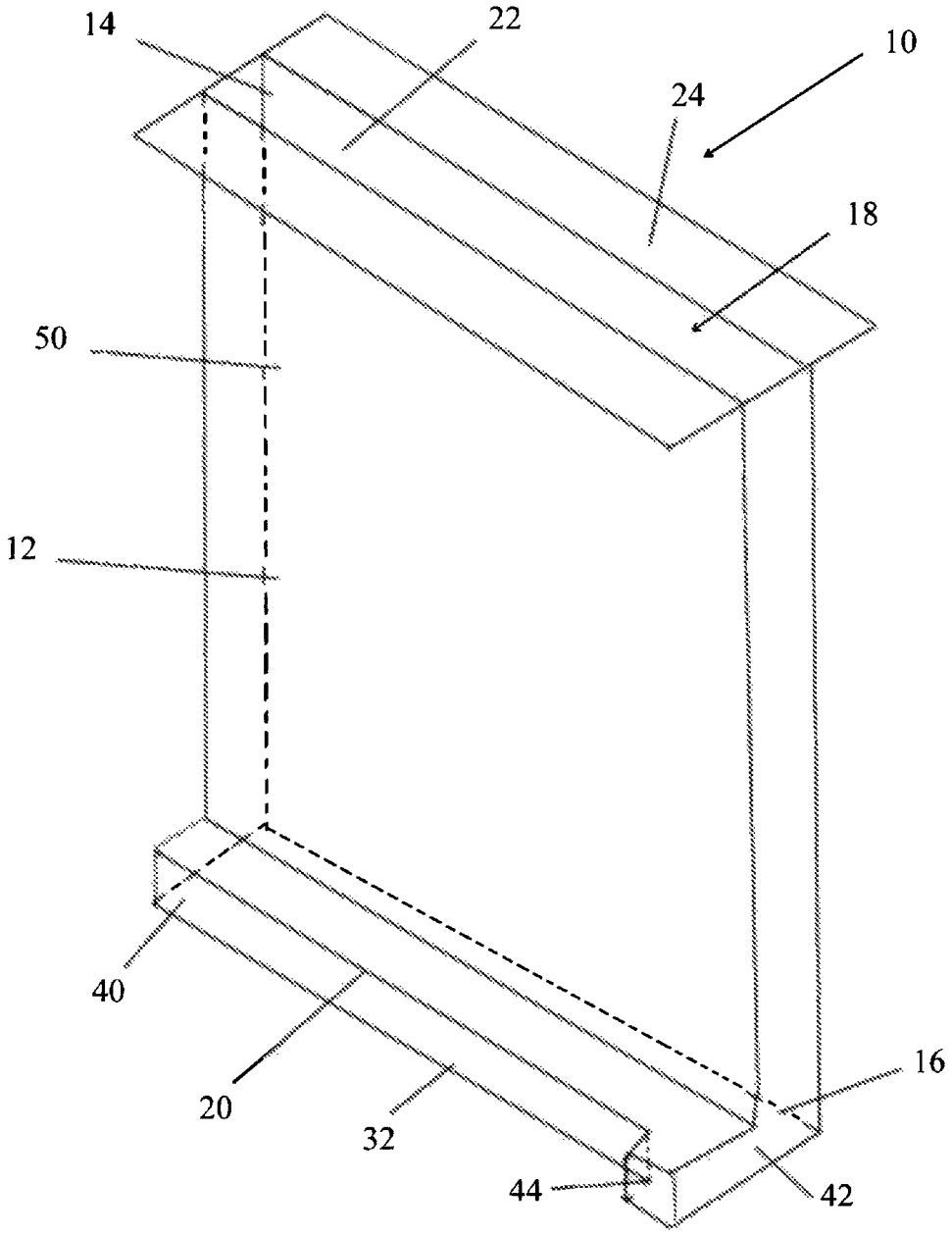
FIG. 1 is a perspective view of a sleeve of an adjustable anchor, in accordance with an aspect of the invention.
Figure 2:
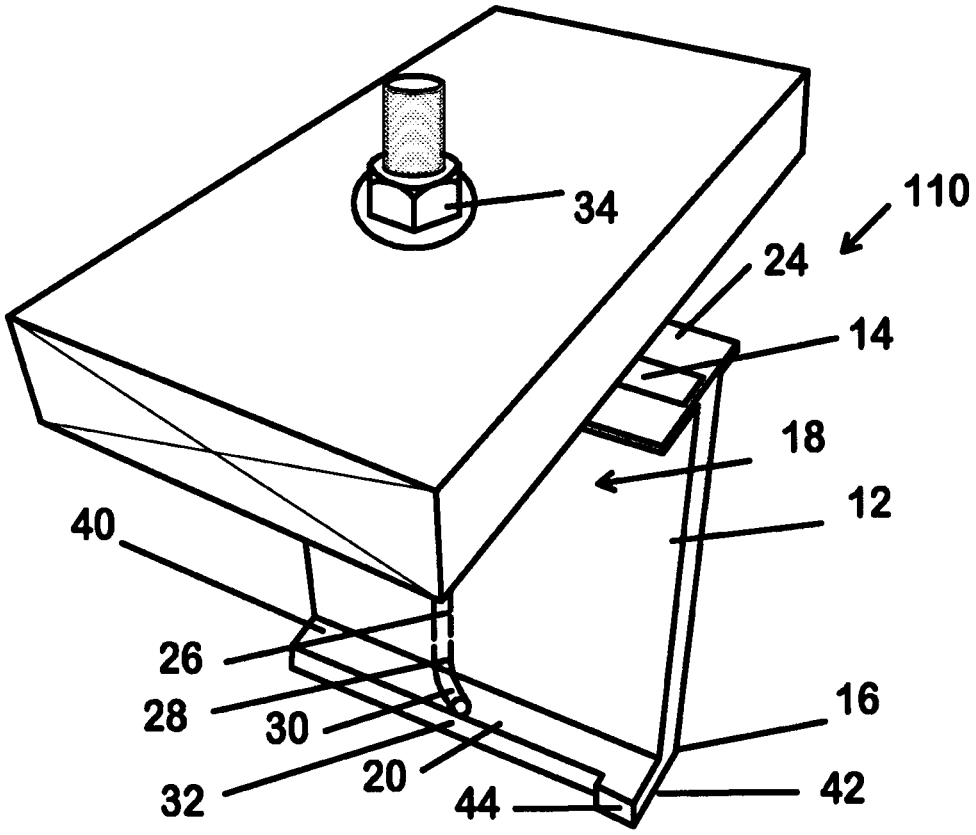
FIG. 2 is a top perspective view of an adjustable anchor with an example frame affixed to the anchor with a cover thereof removed, in accordance with an aspect of the invention.
Figure 3:
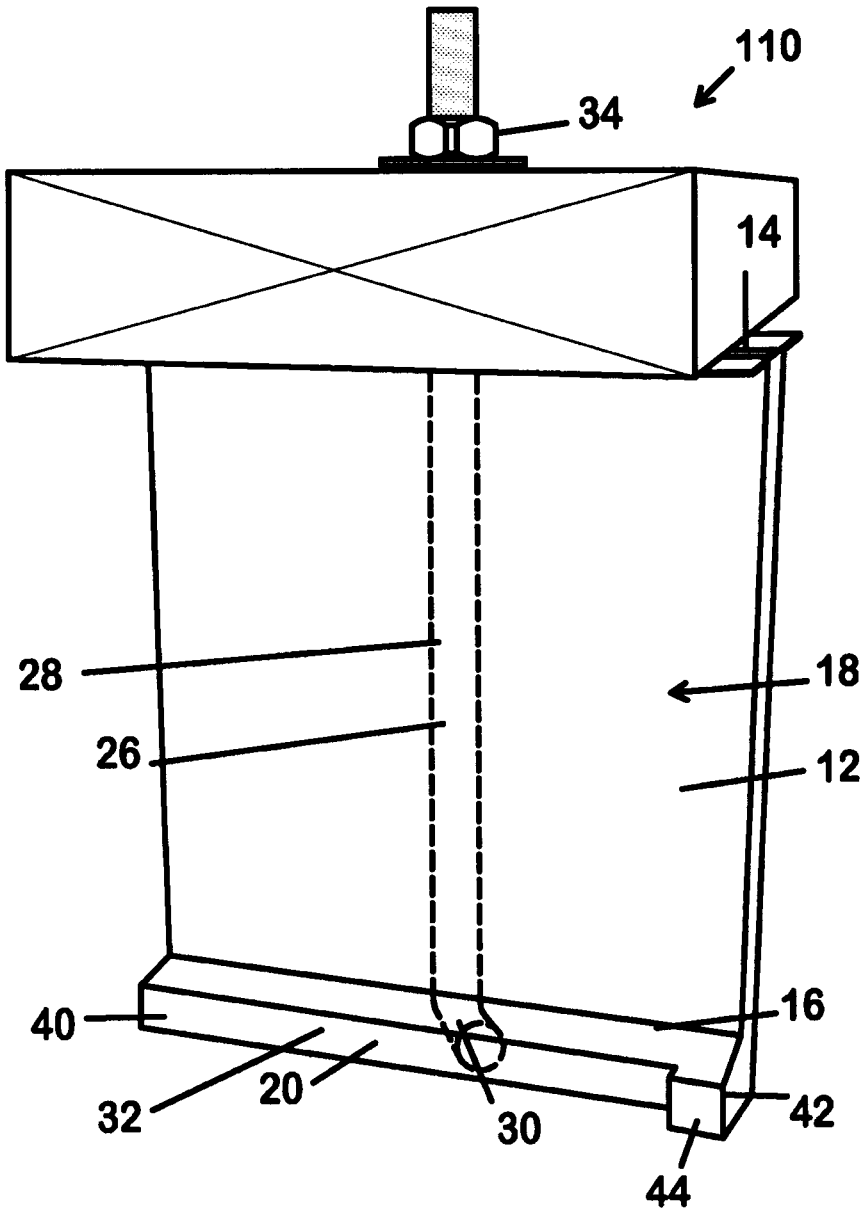
FIG. 3 is a front view of the anchor of FIG. 2.
Figure 4:
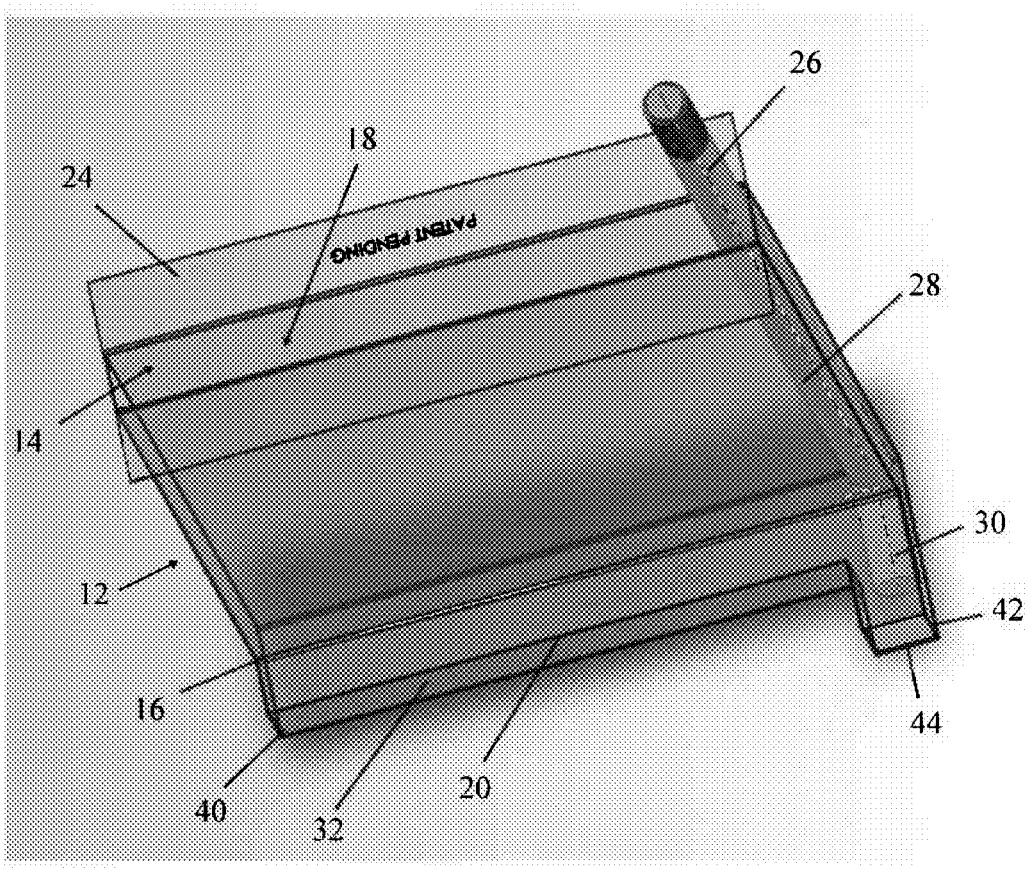
FIG. 4 is a perspective view of the anchor of FIG. 2.
Figure 5:
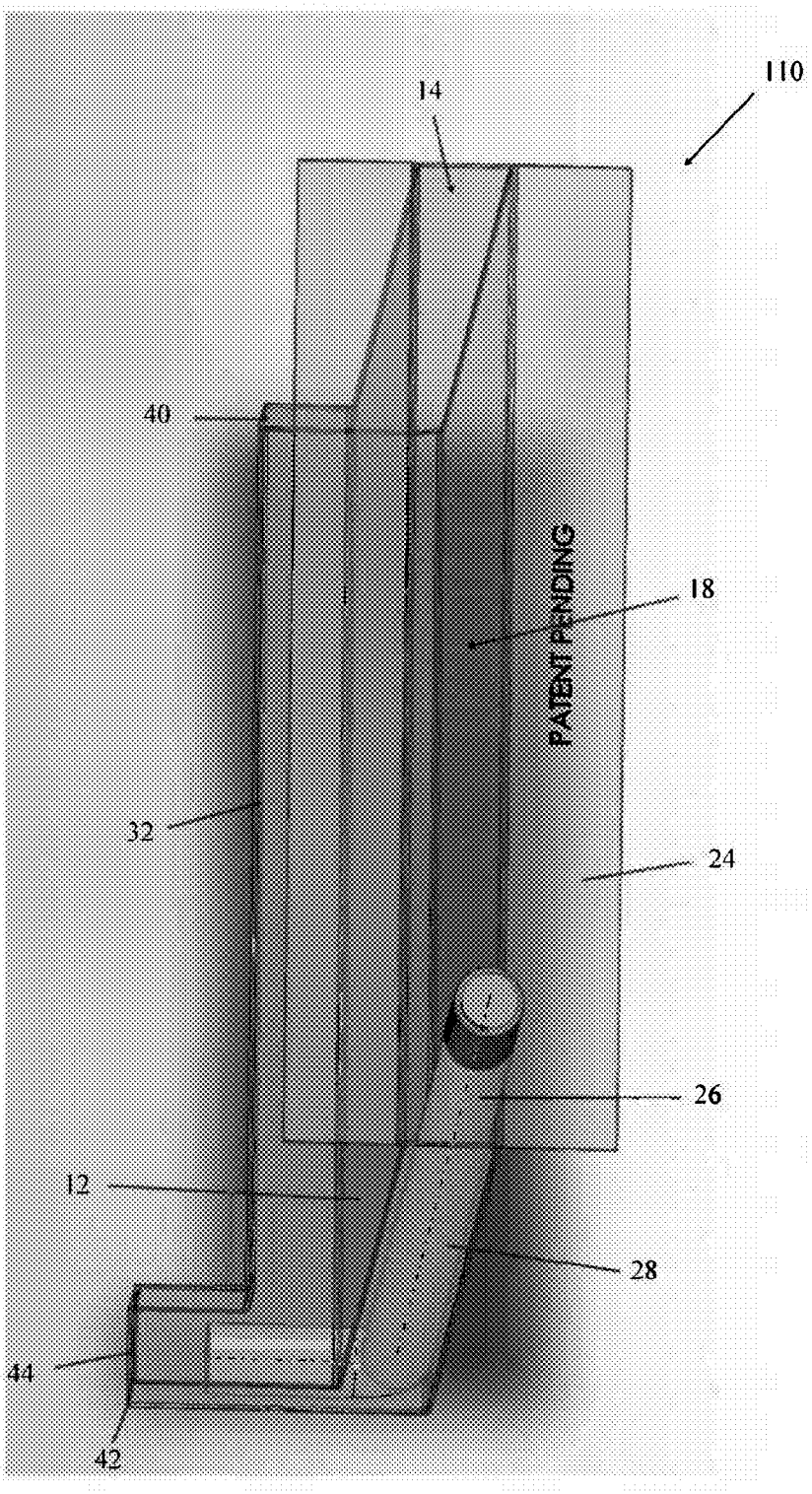
FIG. 5 is top perspective view of the anchor of FIG. 2.
Figure 6:
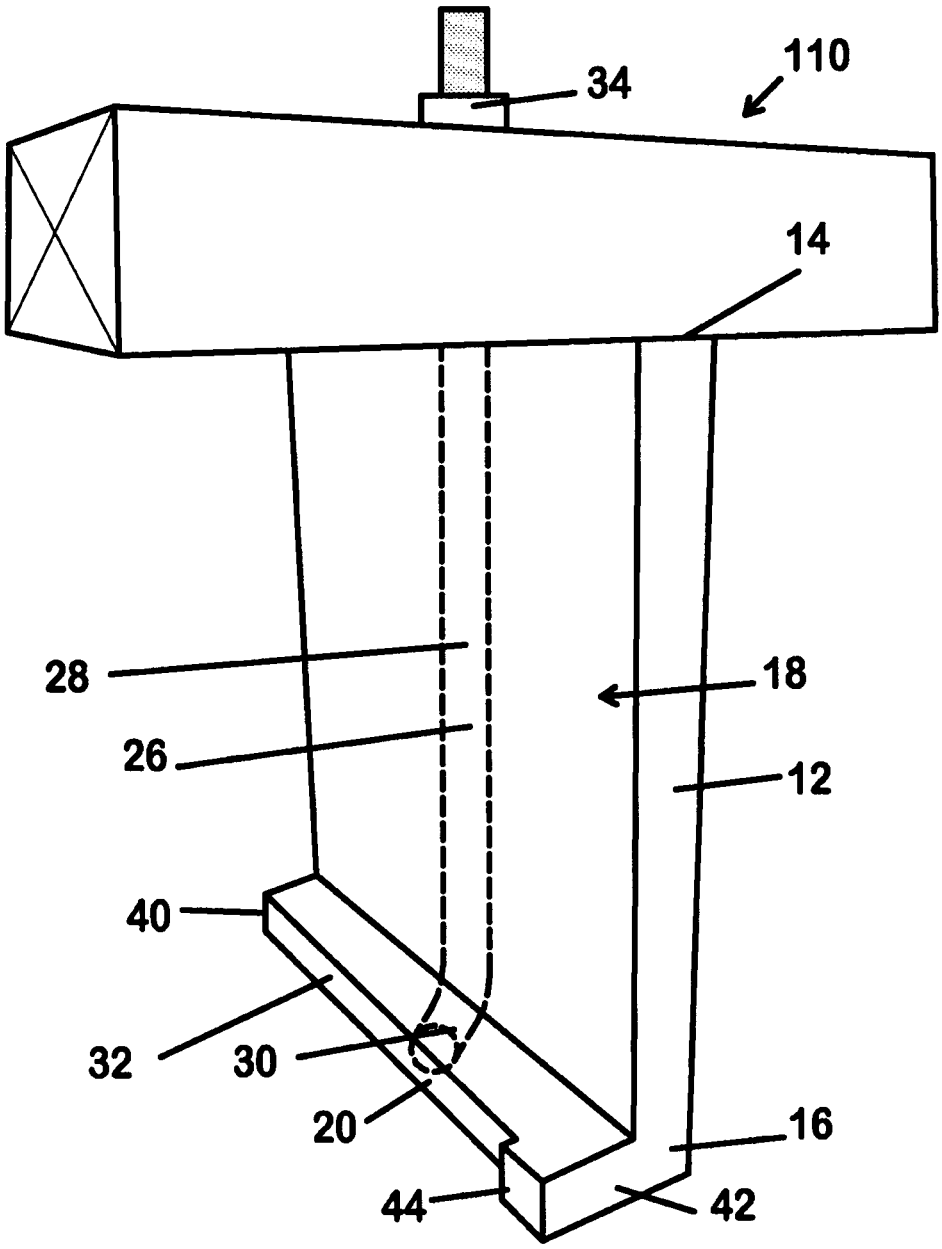
FIG. 6 is a side view of the anchor of FIG. 2.
Figure 7:
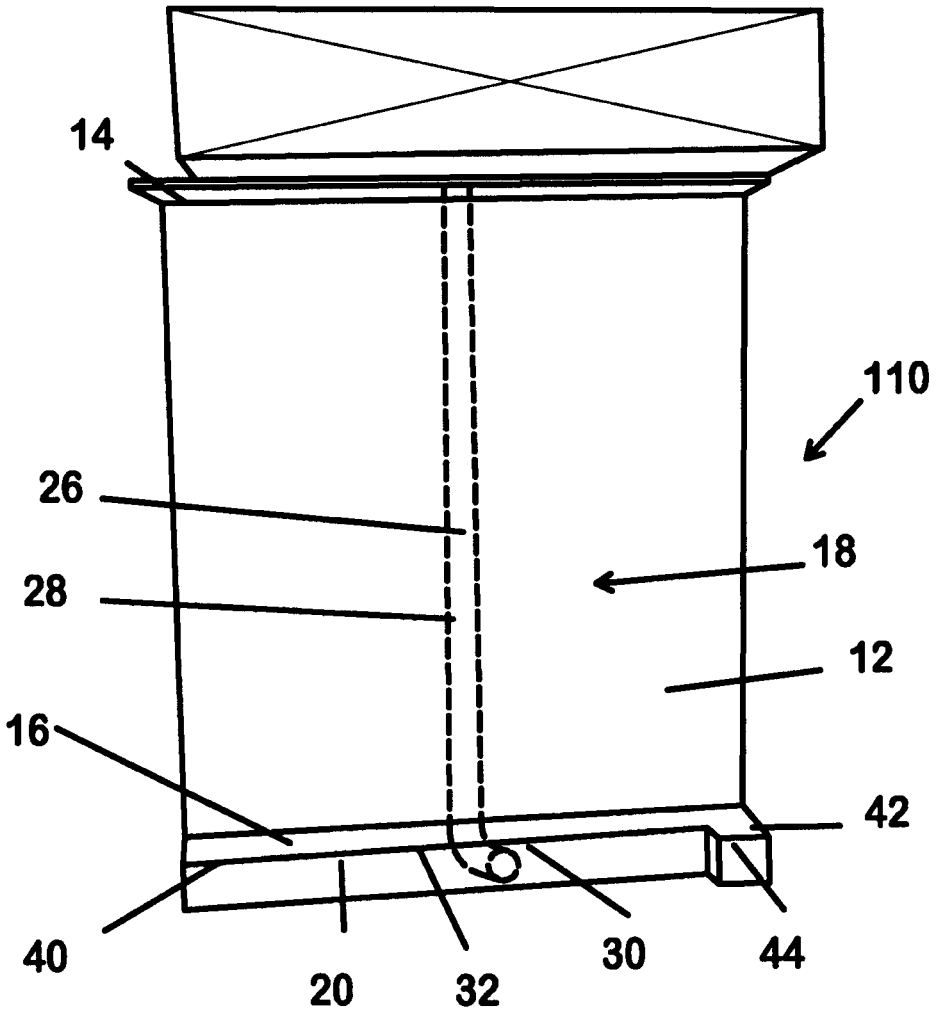
FIG. 7 is a front view of the anchor of FIG. 2.
Figure 8:
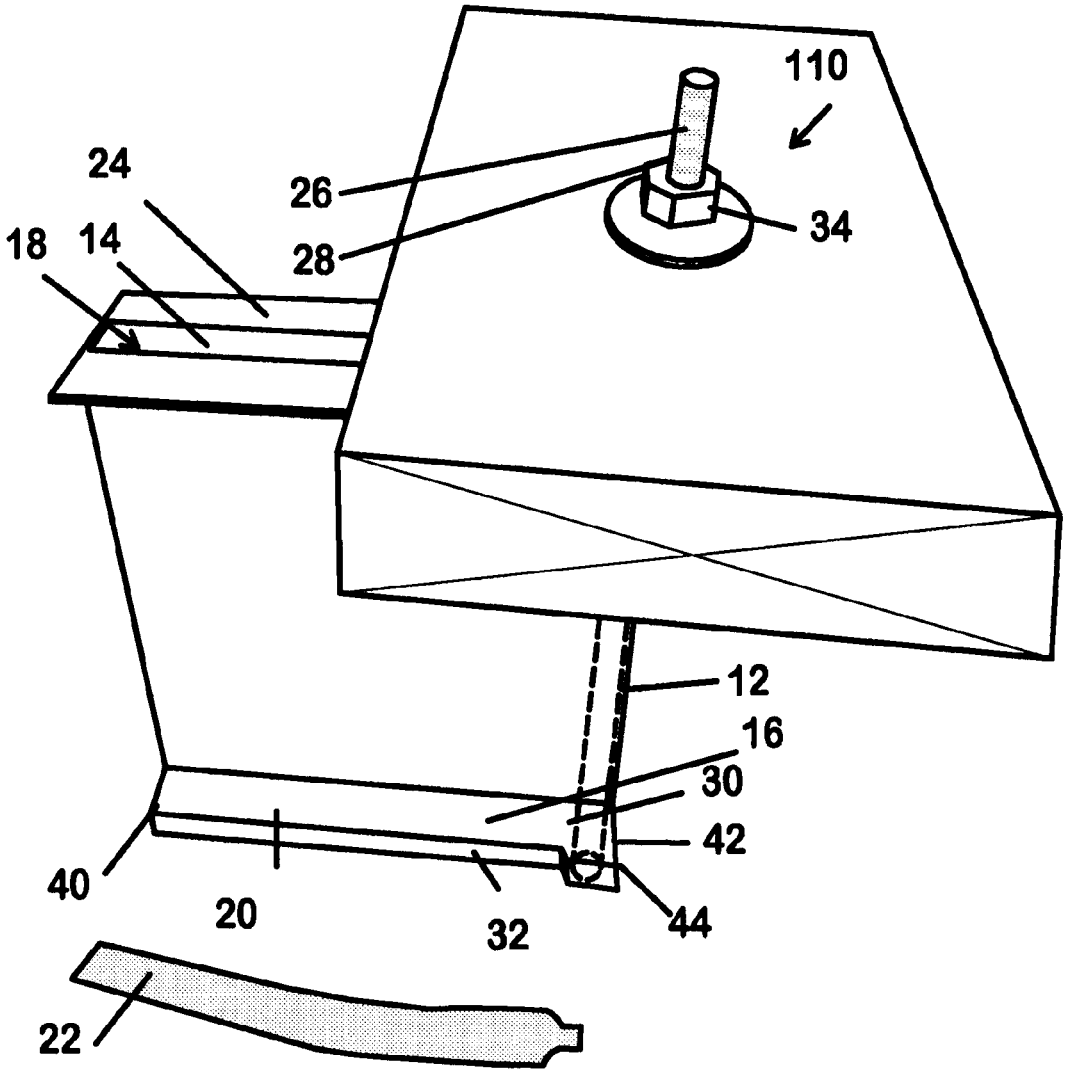
FIG. 8 is a perspective view of the anchor of FIG. 2 where a moveable bolt has been moved to a second lateral end of a foot section of the anchor, in accordance with an aspect of the invention.
Figure 9:
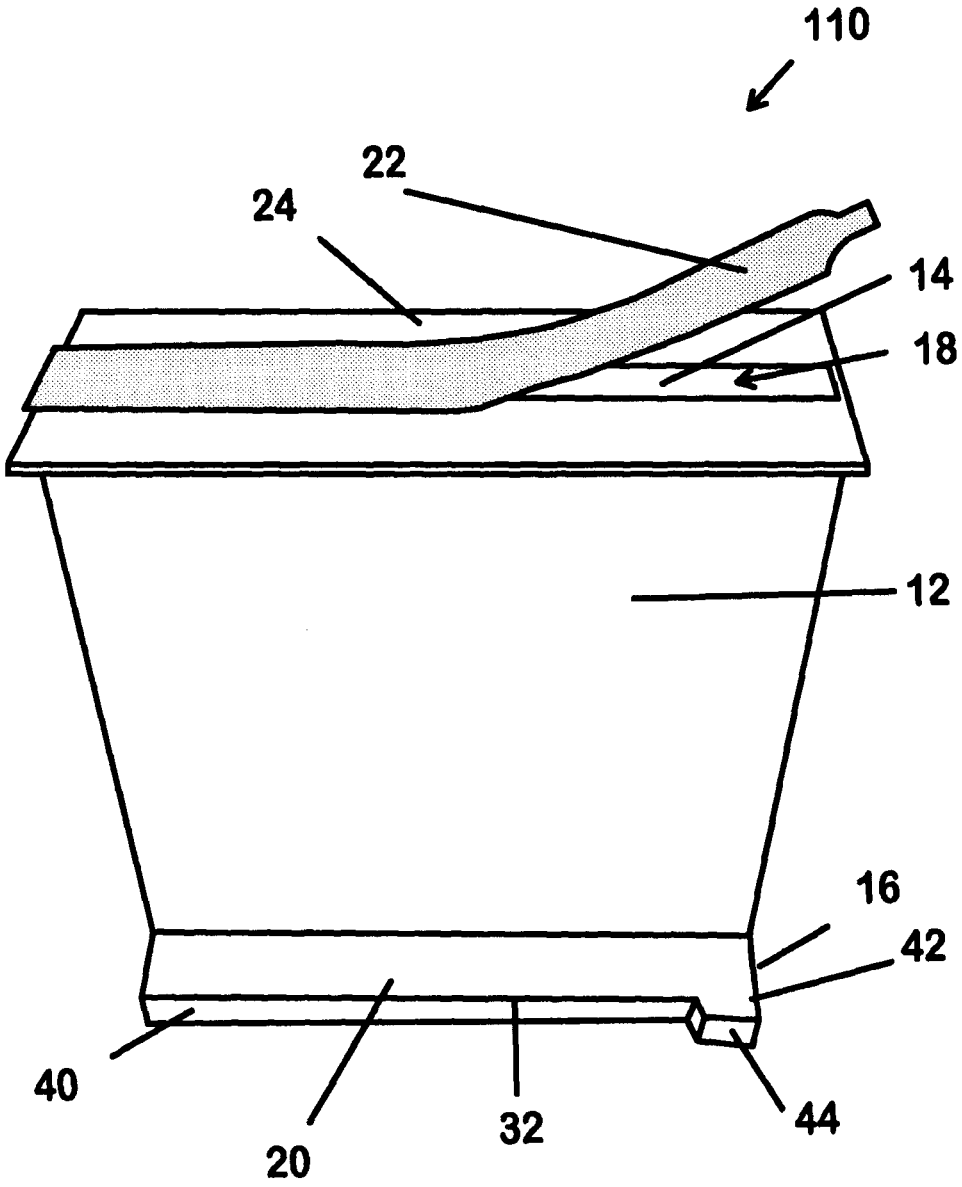
FIG. 9 is a perspective view of a sleeve of an adjustable anchor with the cover partially removed, in accordance with an aspect of the invention.
Figure 10:
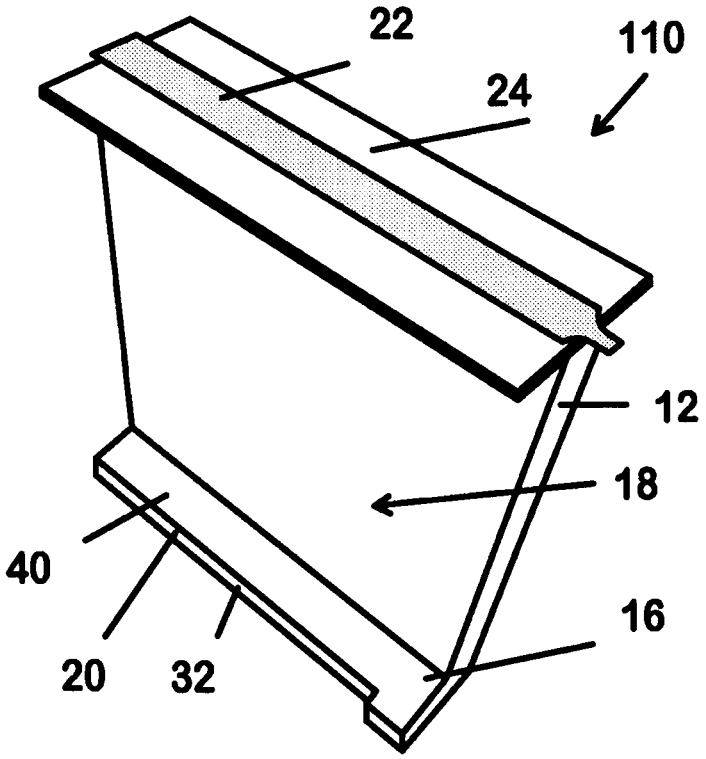
FIG. 10 is a perspective view of a sleeve of an adjustable anchor with the cover attached, in accordance with an aspect of the invention.
Figure 11:
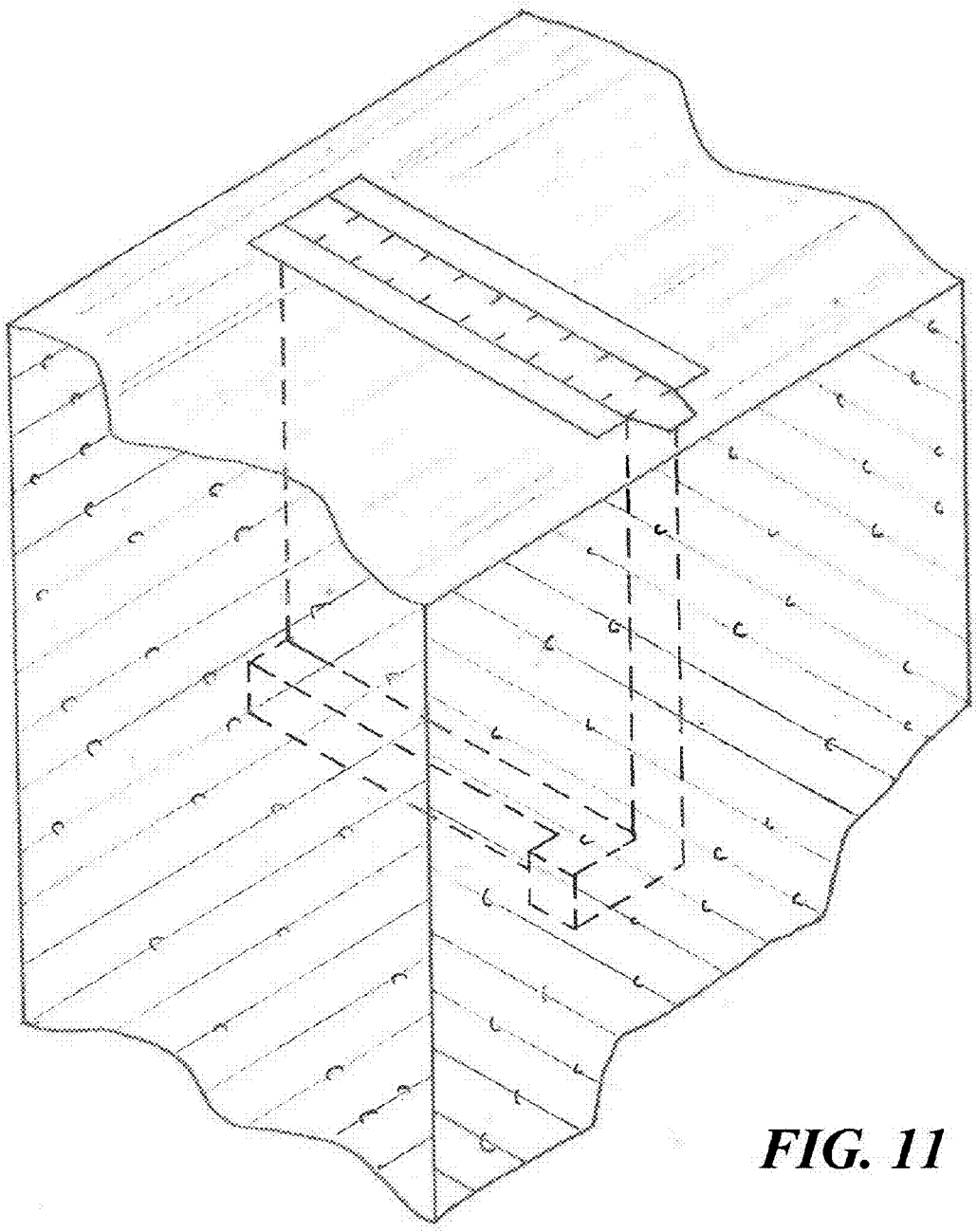
FIG. 11 is a top perspective view of a sleeve of an adjustable anchor with a cover attached and a flange at the open end holding the sleeve at the appropriate height, embedded in a concrete foundation in accordance with an aspect of the invention.
Figure 12:
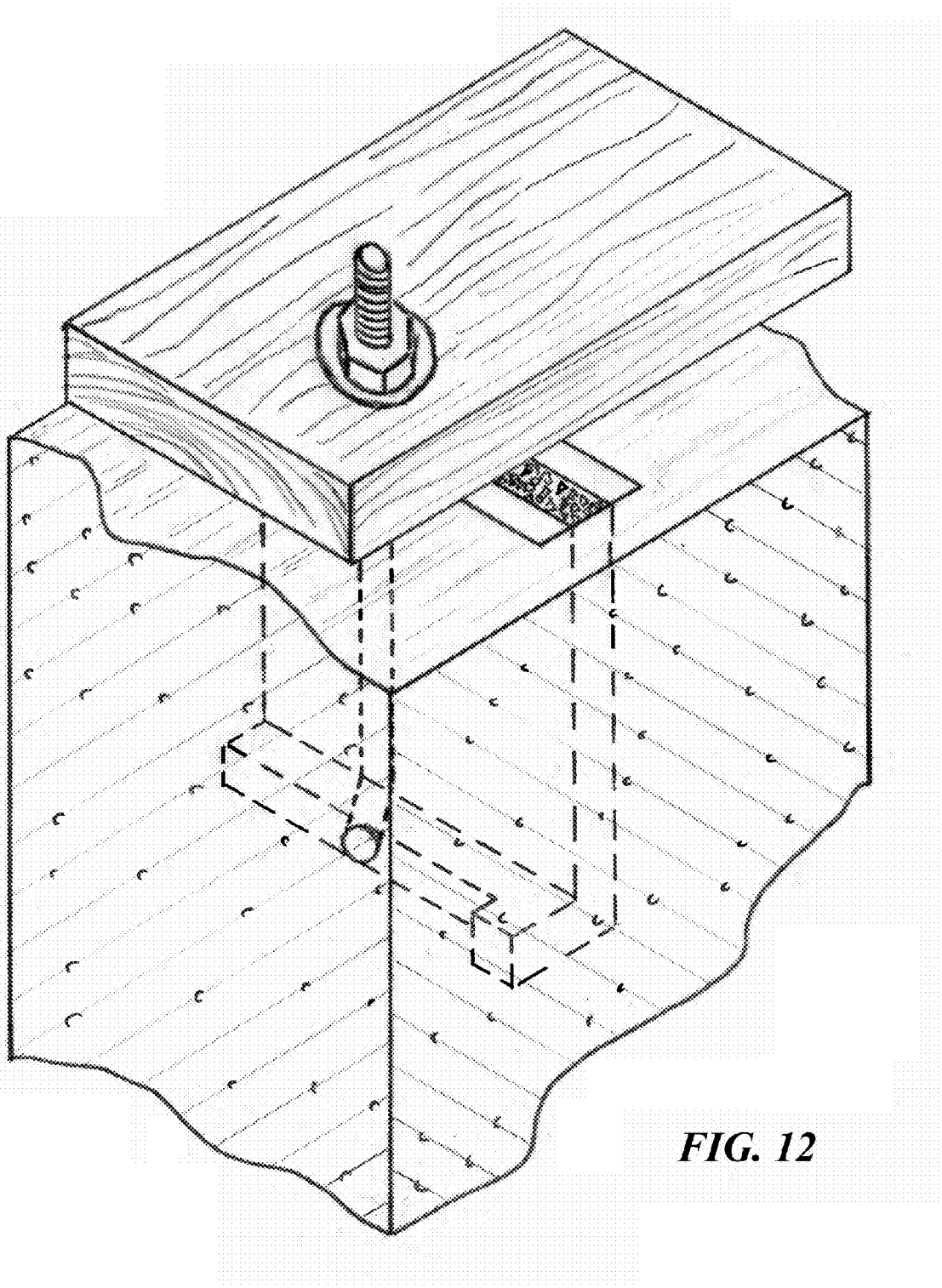
FIG. 12 is a top perspective view of the sleeve and foundation of FIG. 11 with a movable bolt and nut securing an example wood framing to the foundation, where the bolt is disposed to align with the middle third of the framing, and the cavity of the adjustable anchor is filled with one of dirt, concrete, caulk and spray foam in accordance with an aspect of the invention.

For the purposes of promoting an understanding of the principles of the adjustable anchor, reference will now be made to the embodiments, or examples, illustrated in the drawings and specific language will be used to describe these. It will nevertheless be understood that no limitation of the scope of the invention is thereby intended. Any alterations and further modifications in the described embodiments, and any further applications of the principles of the invention as described herein are contemplated as would normally occur to one skilled in the art to which the adjustable anchor relates.

Although specific reference is made throughout the specification to a concrete foundation and wood framing, the disclosure equally applies to other applications of concrete and materials to be attached to concrete with anchors. Other examples include piers, dams, bridges, slabs, and other concrete structures.

Referring now to FIG. 1, one embodiment of an adjustable anchor 10 of the present invention is shown. More specifically, in FIG. 1, a sleeve 12 of an adjustable anchor 10 is shown including an open end 14 and a closed end 16. Sleeve 12 is placed into a position surrounded by concrete, for example in a foundation, as the concrete is setting. Closed end 16 is positioned at a depth within the concrete such that open end 14 is flush with the finalized concrete foundation. Once the concrete is poured, sleeve 12 may be installed in its desired location in a wood form or other frame and held in place by flange 24 until the concrete sets. After the concrete is set and allowed to dry, sleeve 12 is secured within the foundation by the concrete as it is cured. Sleeve 12 may be oriented laterally across the foundation (i.e., a foundation wall) or longitudinally in line with the foundation, depending on a direction of adjustment of the anchor needed by a user. Alternatively, sleeve 12 may be oriented at an angle relative to the direction of the foundation to permit both lateral and longitudinal movement by the same or different sleeves. In the embodiment shown in FIG. 1, sleeve 12 is a rectangular structure and provides for the movement of the anchor in only one direction (i.e. along a longitudinal direction of the sleeve). Other configurations are also contemplated to be within the scope of the invention to permit movement of the anchor in multiple directions. For example, sleeve 12 may be generally cross-, X-, T-, crescent-, circular-, oval-, rectangular-, or polygonal-shaped. The rectangular shape shown in FIG. 1 provides for ease of use and orientation and also permits a maximum of concrete to be poured around sleeve 12 and therefore does not significantly compromise the integrity of the foundation. After the concrete is poured, sleeve 12 may be installed flush with the flange so it may be surrounded by concrete on all sides.

Sleeve 12 may be comprised of any rigid material suitable to be encased in concrete, including, for example, hard plastic, steel, aluminum, or other metals. Sleeve 12 may be able to withstand the pressure and weight of the poured concrete and remain durable through the life of the structure.

Sleeve 12 includes a cavity 18 formed within a rigid wall 50 and extends from open end 14 to closed end 16. Sleeve 12 also includes a hollow foot section 20 formed at closed end 16. Cavity 18 extends the length, width, and height of sleeve 12. Cavity 18 is provided to permit a moveable bolt 26 (shown in FIGS. 2-8) to be moved (e.g. longitudinally) through sleeve 12 and to be positioned at a desirable location within sleeve 12 and permit moveable bolt 26 to be positioned in the middle third of framing (e.g., in a direction orthogonal to a longitudinal dimension of a foundation wall).

Sleeve 12 may also include a cover 22 (shown in FIGS. 1, 4, 8, 9, and 10) removably attached to open end 14 as depicted in FIG. 1. A flange 24 may be attached to sleeve 12 at open end 14. After the concrete has been poured, cover 22 may be removed to permit the insertion of a moveable bolt 26 (shown in FIGS. 2-8). In addition, flange 24 may be optionally attached to cover 22 to provide a grip to remove cover 22. Flange 24 may include a marking or other designation that indicates a proper direction for the insertion of moveable bolt 26 (shown in FIGS. 2-8), more specifically the direction that an angled portion 30 of bolt 26 must face such that angled portion 30 may be received in foot section 20. As shown in FIG. 1, more than one flange 24 may be provided, for example, on each side of sleeve 12. Cover 22 may provide for easy removal and/or directional orientation. In alternative embodiments, cover 22 may be foldably (e.g. via a hinge or bendable connection) attached to sleeve 12 and may be folded to one side to allow placement of movable bolt 26 into cavity 18.

Referring now to FIGS. 2-8, one embodiment of an adjustable anchor 110 includes sleeve 12 and movable bolt 26. Anchor 110 is shown as translucent for example purposes and to permit illustration. Anchor 110 may be constructed of a rigid material that is translucent or solid. Anchor 110 is substantially the same as anchor 10 depicted in FIG. 1 except that cover 22 has been removed. Moveable bolt 26 includes a shaft 28 and angled portion 30. Shaft 28 is disposed within cavity 18 and extends through open end 14 to be affixed to framing, such as sill plates. Shaft 28 extends into sleeve 12 a distance that is sufficient to safely secure the framing to the concrete. Typically, building codes specify a certain depth that the anchor must reach and moveable bolt 26 and sleeve 12 may be at least this depth, with moveable bolt 26 extending the code specified distance into sleeve 12. Angled portion 30 of moveable bolt 26 is provided to fit within hollow foot section 20. Angled portion 30 may rotate slightly with the rotation of moveable bolt 26. Angled portion 30 may come into contact with a wall 32 of hollow foot section 20 and wall 32 may stop a rotation of moveable bolt 26 so that a nut 34 may be tightened onto bolt 26 to secure the framing to adjustable anchor 110 and to the concrete. Although angled portion 30 is shown at a ninety-degree angle relative to shaft 28, angled portion 30 may be disposed at alternative angles, for example, 60 degrees and 120 degrees. In other alternative embodiments, angled portion 30 may be curved. In still other embodiments moveable bolt 26 may be a j-bolt or other anchor bolt.

Hollow foot section 20 may include a first lateral end 40 and a second lateral end 42. First lateral end 40 extends a distance away from cavity 18, but does not extend so far as to permit 180-degree rotation of moveable bolt 26. The rotation of movable bolt 26 is stopped by angled portion 30 coming into contact with wall 32 of hollow foot section 20. Although the rotation of the movable bolt 26 may vary in different applications, in a preferred embodiment the rotation is less than 90 degrees. In another embodiment, moveable bolt 26 rotates more than 45 degrees. Some rotation of moveable bolt 26 is necessary because movable bolt 26 must be held within sleeve 12. The moveable bolt 26 is held in place by angled portion 30 resting within hollow foot section 20. Thus some rotation of moveable bolt 26 is necessary, however over rotation would result in 180 degree rotation, which may result in the accidental removal of movable bolt 26 from sleeve 12 (e.g. rotation such that angled portion 30 would be free to be easily removed from cavity 18).

Second lateral end 42 may include an extended portion 44. Extended portion 44 is provided to permit moveable bolt 26 to completely move to second lateral end 42. Extended portion allows moveable bolt 26 to be rotated by 90 degrees but to still lock in place so that 180-degree rotation is prohibited. This is accomplished by extended portion 44 having a length that is approximately equal to the diameter of angled portion 30. Although extended portion 44 is shown at second lateral end 42 in FIGS. 2-8, in alternative embodiments one or more extended portion 44 may be disposed intermediary first lateral end 40 and second lateral end 42, along hollow foot section 20.

Also shown in FIGS. 2-8 is a cut away portion of framing attached to movable bolt 26 and adjustable anchor 110. Movable bolt 26 is provided within cavity 18 so that it may be moved laterally through cavity 18. The position of movable bolt 26 may therefore be changed, and in most instances the lateral position, relative to the foundational wall, of moveable bolt 26 may be changed. Because the position of moveable bolt 26 can be changed, there is no need to drill into the cement foundation to replace anchors. In addition, wooden framing can be predrilled in a center third portion thereof. The pre-drilling of wooden framing not only saves time, but is also ideal, as the framing can be anchored within the middle third of the framing to provide structural support and stability. The framing may be drilled at a point that is not within the middle third of the framing if desired; however, the adjustable anchor 110 of the present invention is still configured to appropriately position the movable bolt to interface with the framing. The pre-drilling of the framing does not have to be particularly meticulous, as slight variations in the position of the pre-drilled holes can be compensated for by adjusting the position of moveable bolt 26 within cavity 18.

Moveable bolt 26 may be moved through cavity 18 to position movable bolt 26 in the proper position to be placed through framing holes formed in the framing. Once a proper lateral position is found within cavity 18, moveable bolt 26 may be rotated to bring angled portion 30 into contact with wall 32. This prevents or inhibits further rotation and the framing may then be secured to the concrete using nut 34 or other means of attaching the framing to the concrete. Movable bolt 26 cannot be removed from cavity 18 because angled portion 30 is retained within hollow foot section 20. Moveable bolt 26 may be further secured to sleeve 12 through the use of an adhesive. Alternatively, after the proper position of moveable bolt 26 is determined, cavity 18 may be filled with concrete, dirt, caulk, spray foam, or other suitable material, to secure moveable bolt in place before the framing is secured, but not necessary.

The dimensions of adjustable anchor 10 and/or anchor 110 may vary according to the size of the wall that is being constructed. For example, for a wall with an eight inch thickness and where the length, height and width are all defined along the same dimensions, sleeve 12 may have a height of 7.375 inches, a length of 6 inches, and a width of 0.5625 inches, hollow foot section 20 may have a height of 0.5625 inches, a length of 6 inches, and a width of 1.1875 inches, and extended portion 44 may have a height of 0.5625 inches, a length of 0.5 inches, and a width of 1.625 inches. These dimensions are listed for example purposes only. A wall of a different thickness may require a sleeve of different dimensions. Similarly, if more concrete is required at the ends of sleeve 12, sleeve 12 may be made shorter in length. The width and height of sleeve 12 may be varied to accommodate movable bolt 26 having different diameters. For example flange 24 may be 0.75 inches in width, but other sizes and configurations of flange 24 are included within the scope of this disclosure.

As described above, prior art systems that relate to anchor bolts that are simply placed in concrete may not be positioned at an appropriate depth, and there may not be enough room for a nut to be placed on the bolt. Sleeve 12 places moveable bolt 26 at a proper depth. Further, a standard depth of movable bolt 26 results in enough but not too much of movable bolt 26 being exposed for the placement of nut 34. The appropriate depth of an anchor bolt for framing is generally characterized by a sufficient number of exposed threads for the placement of a nut and the nut, when fully tightened, coming in contact with the framing without using all of the threads of the bolt.

Using adjustable anchor 10 and sleeve 12 of the present invention results in greater accuracy and speed in the process of attaching framing to concrete. The speed and accuracy are increased because the framing may be pre-drilled within a center third portion of the framing and the adjustment of the anchor can be made on the spot (i.e. during the action of assembling framing on site). Further, adjustable anchor 10 eliminates or minimizes the need to drill replacement holes and place replacement anchors as described above, thereby speeding up an overall process of attaching framing to a foundation of a building or other structure.

While embodiments of the invention have been illustrated and described in detail in the disclosure, the disclosure is to be considered as illustrative and not restrictive in character. All changes and modifications that come within the spirit of the invention are to be considered within the scope of the disclosure.

The invention claimed is:

1. An anchor-building system, comprising:

a sleeve received in a concrete foundation of a building, the sleeve comprising an open end and a closed end;

a cavity bounded by a rigid wall extending from the open end to the closed end; and a hollow foot section formed at the closed end and in communication with the cavity, said hollow foot section comprising a first lateral end and a second lateral end, said second lateral end comprising an extended portion extending further away from the cavity at the second lateral end than a remainder of said hollow foot portion extends away from said cavity;

a bolt comprising a shaft disposed within the cavity and extending through the open end and an angled portion disposed within the hollow foot section;

said angled portion having a length larger than a width of said cavity such that an end of said angled portion abuts an inner surface of said foot section after said bolt is rotated in said cavity; and the bolt located within the sleeve such that the bolt is in a middle third of framing of the building; and a nut engaged to said bolt to connect said sleeve and said concrete to the framing of the building located on the concrete foundation.

2. The system of claim 1, wherein a flange is attached to the sleeve at the open end, the flange configured to hold the sleeve at an appropriate height while concrete sets, and the sleeve comprising a marking to indicate a proper direction of insertion for the bolt.

3. An adjustable anchor system for use in construction of a building having a concrete foundation, the system comprising:

a sleeve configured to be received in concrete, comprising:

an open end and a closed end;

a cavity formed within a rigid wall extending from the open end to the closed end; and a hollow foot section formed at the closed end and in communication with the cavity, said hollow foot section comprising a first lateral end and a second lateral end, said second lateral end comprising an extended portion extending further away from the cavity at the second lateral end than a remainder of said hollow foot portion extends away from said cavity;

a movable bolt comprising a shaft disposed within the cavity and extending through the open end and an angled portion disposed within the hollow foot section; and said angled portion having a length larger than a width of said cavity such that an end of said angled portion abuts an inner surface of said foot section when said bolt is rotated in said cavity and a nut is engaged to said bolt.

4. The system of claim 3, wherein the sleeve further comprises a flange attached to the sleeve at the open end, the flange configured to hold the sleeve at an appropriate height while concrete sets, and the sleeve comprising a marking to indicate a proper direction of insertion for the bolt.

5. The system of claim 3, wherein the angled portion of the movable bolt is angled at a ninety degree angle relative to the shaft of the movable bolt.

6. A method for movably anchoring a structure to a concrete foundation, the method comprising:

pouring concrete about a target site for an anchor to form a concrete foundation for a building;

inserting and positioning a sleeve at the target site for the anchor, the sleeve comprising an open end and a closed end, a cavity bounded by a rigid wall extending from the open end to the closed end and a hollow foot section formed at the closed end and in communication with the cavity, the hollow foot section comprising a first lateral end and a second lateral end, the second lateral end comprising an extended portion extending further away from the cavity at the second lateral end than a remainder of the hollow foot portion extends away from the cavity;

allowing the concrete to harden;

disposing a movable bolt within the sleeve, the bolt comprising a shaft and an angled portion, the shaft disposed within the cavity and the angled portion configured to be disposed within the hollow foot section;

adjusting a location of the bolt within the sleeve such that the bolt is in a middle third of a frame of the building;

rotating the movable bolt to dispose the angled portion within the hollow foot section such that an end of the bolt contacts an inner surface of the sleeve such that the end stops; and securing the frame to the concrete foundation by connecting the frame to the moveable bolt by engaging threads of a nut to the bolt, the bolt being stationary during the engaging due to the end of the bolt contacting the inner surface of the sleeve.

7. The method of claim 6, further comprising removing a cover from the open end of the sleeve.

8. The method of claim 6, further comprising moving the moveable bolt through the cavity to a desired position.

9. The method of claim 6, further comprising filling the cavity with at least one of dirt, concrete, caulk, and spray foam.

10. The system of claim 1 wherein said framing comprises wood framing.

11. The system of claim 6 wherein the frame comprises wood framing.

12. The system of claim 11 wherein said framing comprises wood framing.

13. The system of claim 1 wherein said bolt is J-shaped.

14. The system of claim 3 wherein said bolt is J-shaped.

15. The method of claim 6 wherein the bolt is J-shaped.

16. The method of claim 6 wherein the angled portion has a length larger than a width of the cavity such that the end of the bolt contacts the inner surface of the sleeve such that the end stops.

17. The method of claim 6 wherein the nut is located outside the cavity of the sleeve.

18. The sleeve of claim 1 wherein said cavity receiving said shaft and said hollow foot section receiving said angled portion are about orthogonal relative to each other.

19. An anchor-building system, comprising:

a sleeve received in a concrete foundation of a building, the sleeve comprising an open end and a closed end;

a cavity bounded by a rigid wall extending from the open end to the closed end; and a hollow foot section formed at the closed end and in communication with the cavity;

a J-shaped bolt comprising a shaft disposed within the cavity and extending through the open end and an angled portion disposed within the hollow foot section;

said angled portion having a length larger than a width of said cavity such that an end of said angled portion abuts an inner surface of said foot section after said bolt is rotated in said cavity; and the bolt located within the sleeve such that the bolt is in a middle third of framing of the building; and a nut engaged to said bolt to connect said sleeve and said concrete to the framing of the building located on the concrete foundation.

20. An adjustable anchor system for use in construction of a building having a concrete foundation, the system comprising:

a sleeve configured to be received in concrete, comprising:

an open end and a closed end;

a cavity formed within a rigid wall extending from the open end to the closed end; and a hollow foot section formed at the closed end and in communication with the cavity, and a movable J-shaped bolt comprising a shaft disposed within the cavity and extending through the open end and an angled portion disposed within the hollow foot section; and said angled portion having a length larger than a width of said cavity such that an end of said angled portion abuts an inner surface of said foot section when said bolt is rotated in said cavity and a nut is engaged to said bolt.

21. A method for movably anchoring a structure to a concrete foundation, the method comprising:

pouring concrete about a target site for an anchor to form a concrete foundation for a building;

inserting and positioning a sleeve at the target site for the anchor, the sleeve comprising an open end and a closed end, a cavity bounded by a rigid wall extending from the open end to the closed end and a hollow foot section formed at the closed end and in communication with the cavity;

allowing the concrete to harden;

disposing a movable J-shaped bolt within the sleeve, the bolt comprising a shaft and an angled portion, the shaft disposed within the cavity and the angled portion configured to be disposed within the hollow foot section;

adjusting a location of the bolt within the sleeve such that the bolt is in a middle third of a frame of the building;

rotating the movable bolt to dispose the angled portion within the hollow foot section such that an end of the bolt contacts an inner surface of the sleeve such that the end stops; and securing the frame to the concrete foundation by connecting the frame to the moveable bolt by engaging threads of a nut to the bolt, the bolt being stationary during the engaging due to the end of the bolt contacting the inner surface of the sleeve.

* * * * *